US009450318B2

(12) United States Patent
Hasegawa

(10) Patent No.: US 9,450,318 B2
(45) Date of Patent: Sep. 20, 2016

(54) ELECTRICAL CONNECTOR ASSEMBLY

(71) Applicant: HIROSE ELECTRIC CO., LTD., Tokyo (JP)

(72) Inventor: Yohei Hasegawa, Tokyo (JP)

(73) Assignee: HIROSE ELECTRIC CO., LTD., Tokyo (JP)

( * ) Notice: Subject to any disclaimer, the term of this patent is extended or adjusted under 35 U.S.C. 154(b) by 0 days.

(21) Appl. No.: 14/832,175

(22) Filed: Aug. 21, 2015

(65) Prior Publication Data

US 2016/0064843 A1 Mar. 3, 2016

(30) Foreign Application Priority Data

Aug. 27, 2014 (JP) ..... 2014-172703

(51) Int. Cl.
*H01R 12/52* (2011.01)
*H01R 12/73* (2011.01)
*H01R 12/71* (2011.01)

(52) U.S. Cl.
CPC ..... *H01R 12/73* (2013.01); *H01R 12/716* (2013.01)

(58) Field of Classification Search
CPC ..... H01R 12/52; H01R 23/725; H01R 9/096
USPC ..... 439/74, 62
See application file for complete search history.

(56) References Cited

U.S. PATENT DOCUMENTS 6,390,828 B1 * 5/2002 Yamaguchi ..... H01R 13/631 439/247
7,320,606 B2 * 1/2008 Midorikawa ..... H01R 12/716 439/660
7,794,238 B2 * 9/2010 Chen ..... H01R 13/20 439/660
7,845,958 B2 * 12/2010 Hoshino ..... H01R 12/716 439/660
7,922,499 B2 * 4/2011 Liao ..... H01R 12/714 439/660
8,540,534 B2 * 9/2013 Sato ..... H01R 13/11 439/660
8,888,507 B2 * 11/2014 Chen ..... H01R 12/712 439/74
8,888,508 B2 * 11/2014 Chen ..... H01R 12/712 439/74
2005/0009383 A1 * 1/2005 Okura ..... H01R 13/6275 439/74
2005/0101163 A1 * 5/2005 Obikane ..... H01R 13/6471 439/74
2007/0105408 A1 * 5/2007 Ookura ..... H01R 12/707 439/74
2007/0141866 A1 * 6/2007 Kishi ..... H01R 13/41 439/74
2007/0141867 A1 * 6/2007 Kishi ..... H01R 12/716 439/74
2010/0068900 A1 * 3/2010 Wu ..... H01R 12/716 439/74
2013/0012039 A1 * 1/2013 Nose ..... H01R 12/716 439/74

FOREIGN PATENT DOCUMENTS

JP 2007-35291 2/2007

* cited by examiner

*Primary Examiner* — Gary Paumen
(74) *Attorney, Agent, or Firm* — Procopio, Cory, Hargreaves & Savitch LLP

(57) ABSTRACT

In the terminals of the first electrical connector, the elastic arm portions are formed such that their width dimensions in the array direction of the above-mentioned terminals are smaller than the securing arm portions; in the terminals of the second electrical connector, the sections that correspond to the securing arm portions are formed such that their width dimensions are smaller than the sections that correspond to the elastic arm portions; on the elastic arm portions side, the terminals of the first electrical connector are formed such that their width dimensions are smaller than the terminals of the second electrical connector; and on the securing arm portions side, the terminals of the second electrical connector are formed such that their width dimensions are smaller than the terminals of the first electrical connector.

6 Claims, 8 Drawing Sheets

ELECTRICAL CONNECTOR ASSEMBLY

The present application claims the benefit of foreign priority under 35 USC §119 based Japanese Patent Application No. 2014-172703, filed Aug. 27, 2014, the contents of which is incorporated herein in its entirety by reference.

BACKGROUND

1. Technical Field

The present invention relates to an electrical connector assembly in which a first electrical connector disposed on a circuit board is mutually mated with a second electrical connector disposed on another circuit board, with the direction of mating being the direction of diametrical opposition of the circuit boards.

2. Related Art

Well-known electrical connector assemblies of this type include electrical connector assemblies in which a plug connector is mated with a receptacle connector employed as an electrical connector for circuit boards, for example, such as the one described in Patent Document 1. Multiple receptacle terminals are retained in array form on the housing of the receptacle connector and multiple plug terminals are retained in array form on the housing of the plug connector. The respective receptacle terminals and plug terminals are fabricated by bending metal strip-shaped pieces in the sheet thickness direction.

The receptacle terminals have U-shaped receiving portions used for receiving the hereinafter described nesting portions of the plug terminals. Said receiving portions have contact arm portions and lock arm portions arranged parallel to each other in the vertical direction. The contact arm portions, which are formed at the free ends of the receiving portions, are elastically displaceable in the sheet thickness direction, and contact protrusions used for contacting the plug terminals are formed in a convex-curved configuration toward the lock arm portions. On the other hand, the lock arm portions are secured to the housing, and lock protrusions used for locking to the plug terminals are formed to protrude from the major surfaces of said lock arm portions toward the contact arm portions. While the above-mentioned receiving portions are formed to have almost the same width dimensions (dimensions in the terminal array direction) throughout the entire length, the sections positioned in the vicinity of the upper ends (free ends) of the contact arm portions are somewhat narrower in width than other portions.

The plug terminals have U-shaped nesting portions nested into the receiving portions of the receptacle terminals when the connectors are mated. Said nesting portions have corresponding contact arm portions and lockable arm portions arranged parallel to each other and extending in the vertical direction. The corresponding contact arm portions are secured to the housing, and recessed contact portions contacting the contact protrusions of the receptacle terminals are formed sunk into the major surfaces of the above-mentioned corresponding contact arm portions. In addition, the lockable arm portions are secured to the housing, and lockable recessed portions that can engage and lock to the lock protrusions of the receptacle terminals are formed sunk into the major surfaces of the above-mentioned lockable arm portions. The above-mentioned nesting portions are formed to have almost the same width dimensions (dimensions in the terminal array direction) throughout their entire length, and their width dimensions are somewhat larger than the width dimensions of the receiving portions of the receptacle terminals.

PRIOR-ART LITERATURE

Patent Literature

[Patent Document 1]

Japanese Patent Application Publication No. 2007-035291.

Problems to be Solved by the Invention

Generally speaking, if an electrical connector has a plurality of terminals retained thereon in array form in a single direction, the electrical connector can be made more compact in the terminal array direction by decreasing the spacing between the terminals and arranging the terminals in a tightly spaced relationship. Accordingly, in Patent Document 1, with the exception of the narrow sections of the contact arm portions, the receiving portions of mutually adjacent receptacle terminals are placed in a closely spaced relationship throughout almost the entire length. In addition, throughout the entire length, the nesting portions of mutually adjacent plug terminals are placed in close proximity with spacing smaller than the spacing between the above-mentioned receiving portions. As a result, when the electrical connectors are mated and electrical signals (in particular, high-speed signals) are transmitted by the plug terminals and receptacle terminals, there is a risk that the above-mentioned electrical signals may interfere with each other and signal transmission by the terminals may become unstable in the area where adjacent receptacle terminals and plug terminals are placed in close proximity to one another.

SUMMARY

The present invention takes such circumstances into consideration and it is an object of the invention to provide an electrical connector assembly wherein, despite arranging multiple terminals in a tightly spaced relationship, electrical signals between adjacent terminals are unlikely to interfere with one another, and stable signal transmission can be implemented while avoiding an increase in the dimensions of the electrical connectors in the terminal array direction.

Means for Solving the Problems

The electrical connector assembly according to the present invention is one in which a first electrical connector disposed on a circuit board is mutually mated with a second electrical connector disposed on another circuit board, with the direction of mating being the direction of diametrical opposition of the circuit boards, such that, in said electrical connector assembly: the two electrical connectors have a plurality of terminals fabricated by bending metal strip-shaped pieces in the sheet thickness direction and housings that retain the above-mentioned plurality of terminals in array form such that the array direction is a direction (e.g., single direction) parallel to the surface of the circuit boards; the terminals of the first electrical connector have U-shaped receiving portions formed therein that have elastic arm portions elastically displaceable in the above-mentioned sheet thickness direction on one side and securing arm portions secured to the housing on the other side, with the above-mentioned elastic arm portions having contact portions used to provide contact with the terminals of the second electrical connector; and the terminals of the second electrical connector have nesting portions nestable into the receiving portions of the terminals of the first electrical connector.

In such an electrical connector assembly, according to the present invention, in the terminals of the first electrical connector, the above-mentioned elastic arm portions are formed such that their width dimensions in the above-mentioned array direction are smaller than the above-mentioned securing arm portions; in the terminals of the second electrical connector, the sections that correspond to the above-mentioned securing arm portions are formed such that their width dimensions are smaller than the sections that correspond to the above-mentioned elastic arm portions; on the above-mentioned elastic arm portions side, the terminals of the first electrical connector are formed such that their width dimensions are smaller than the terminals of the second electrical connector; and on the above-mentioned securing arm portions side, the terminals of the second electrical connector are formed such that their width dimensions are smaller than the terminals of the first electrical connector.

In the present invention, the elastic arm portions used to provide contact between the terminals of the first electrical connector and the terminals of the second electrical connector are formed such that their width dimensions in the array direction are smaller than those of the securing arm portions. Accordingly, the spacing between the elastic arm portions of the mutually adjacent terminals of said first electrical connector is larger than the spacing between the securing arm portions. In this manner, forming large gaps between the elastic arm portions allows for minimizing electrical signal interference between the terminals of the above-mentioned first electrical connector.

In addition, due to the fact that the present invention is configured such that the securing arm portions of the terminals of the first electrical connector and the sections of the terminals of the second electrical connector that correspond to the above-mentioned securing arm portions are brought into contact, and electrical signal transmission is thus enabled between the above-mentioned securing arm portions and the sections that correspond to said securing arm portions, the number of terminal contact locations is increased to two locations, thereby allowing for the reliability of electrical signal transmission to be improved. In the present invention, the sections of the terminals of the second electrical connector that correspond to the securing arm portions are formed to have width dimensions that are smaller than the sections that correspond to the elastic arm portions. Accordingly, the spacing between the sections of the mutually adjacent terminals of the second electrical connector that correspond to the securing arm portions is larger than the spacing between the sections that correspond to the elastic arm portions. As a result, even if the securing arm portions and the sections that correspond to said securing arm portions are brought into contact as described above, electrical signal interference between the terminals of the above-mentioned second electrical connector can be minimized because large gaps are formed between the sections that correspond to the securing arm portions.

Furthermore, on the elastic arm portions side, the terminals of the first electrical connector are formed to have smaller width dimensions than the terminals of the second electrical connector, and on the securing arm portions side, the terminals of the second electrical connector are formed to have smaller width dimensions than the terminals of the first electrical connector. This means that in order to minimize electrical signal interference between adjacent terminals, the width dimensions of the terminals of the two electrical connectors are kept within the range of the width dimensions of the terminals of the second electrical connector on the above-mentioned elastic arm portions side and within the range of the width dimensions of the terminals of the first electrical connector on the above-mentioned securing arm portions side. Accordingly, even though the terminals are arranged in a tightly spaced relationship, the spacing between the elastic arm portions of the terminals of the first electrical connector and the spacing between the sections of the terminals of the second electrical connector that correspond to the above-mentioned securing arm portions can be respectively increased. In other words, there is no need to increase the array spacing of the terminals as a whole in order to minimize the electrical signal interference, and an increase in the size of the two electrical connectors in the above-mentioned array direction can be avoided.

In the present invention, the width dimensions of the terminals of the first electrical connector may be decreased from the securing arm portions toward the elastic arm portions, and the width dimensions of the terminals of the second electrical connector may be decreased from the sections that correspond to the above-mentioned elastic arm portions toward the sections that correspond to the above-mentioned securing arm portions.

When the width dimensions of the terminals of the first electrical connector are thus decreased from the securing arm portions toward the elastic arm portions, the width dimensions of the terminals of said first electrical connector are largest in the securing arm portions and they are never larger than the width dimensions of said securing arm portions in the section between the securing arm portions and elastic arm portions. In addition, when the width dimensions of the terminals of the second electrical connector are decreased from the sections that correspond to the above-mentioned elastic arm portions toward the sections that correspond to the above-mentioned securing arm portions, the width dimensions of the terminals of said second electrical connector are largest in the sections that correspond to the elastic arm portions and they are never larger than the width dimensions of the sections that correspond to the elastic arm portions in the section between the sections that correspond to the elastic arm portions and the sections that correspond to the securing arm portions. Accordingly, the width dimensions of the terminals of the two electrical connectors are never excessively large and an increase in the size of the two electrical connectors in the above-mentioned array direction can be avoided.

In the present invention, the terminals of the first electrical connector may have lock portions in the securing arm portions, and the terminals of the second electrical connector may have lockable portions, engageable with the above-mentioned lock portions, in above-mentioned sections that correspond to the securing arm portions. Thus, inadvertent disengagement of the electrical connectors can be prevented by providing the lock portions and lockable portions and engaging them with one another.

In the present invention, the lock portions of the terminals of the first electrical connector are recessed portions formed sunk into the major surfaces of the securing arm portions, and the lockable portions of the terminals of the second electrical connector are formed as stepped portions or protrusions that can be inserted into the above-mentioned lock portions on the major surfaces of the above-mentioned sections that correspond to the securing arm portions.

In the terminals of the first electrical connector, the securing arm portions are formed to have larger width dimensions (dimensions in the array direction of the terminals), and in the terminals of the second electrical connector, the sections that correspond to the above-mentioned securing arm portions are formed to have width dimensions smaller than the above-mentioned securing arm portions. Consequently, according to the invention, if the lock portions provided in the above-mentioned securing arm portions are formed as recessed portions, the width dimensions of the recessed portions can be made larger than if the lockable portions of the sections that correspond to the above-mentioned securing arm portions were formed as recessed portions. As a result, by maximizing the width dimensions of the above-mentioned recessed portions, large engageable width dimensions can be ensured for the lock portions and lockable portions, which makes it possible to improve locking strength.

Effects of the Invention

In the inventive electrical connector assembly, since the elastic arm portions of the terminals of the first electrical connector are formed to have small width dimensions and the sections that correspond to the securing arm portions of the terminals of the second electrical connector are formed to have small width dimensions, the spacing between the elastic arm portions of adjacent terminals in the first electrical connector and the spacing between the sections that correspond to the securing arm portions of adjacent terminals in the second electrical connector is made large. Accordingly, electrical signal interference between the terminals of the above-mentioned first electrical connector and between the terminals of the above-mentioned second connector can be minimized. In addition, since the width dimensions of the terminals of the two connectors fall within the range of the width dimensions of the terminals of the second electrical connector on the above-mentioned elastic arm portions side and within the range of the width dimensions of the terminals of the first electrical connector on the above-mentioned securing arm portions side, there is no increase in the size of the electrical connectors in the terminal array direction.

DETAILED DESCRIPTION

Embodiments of the present invention will now be described through reference to the drawings.

First Embodiment

Figure 1:
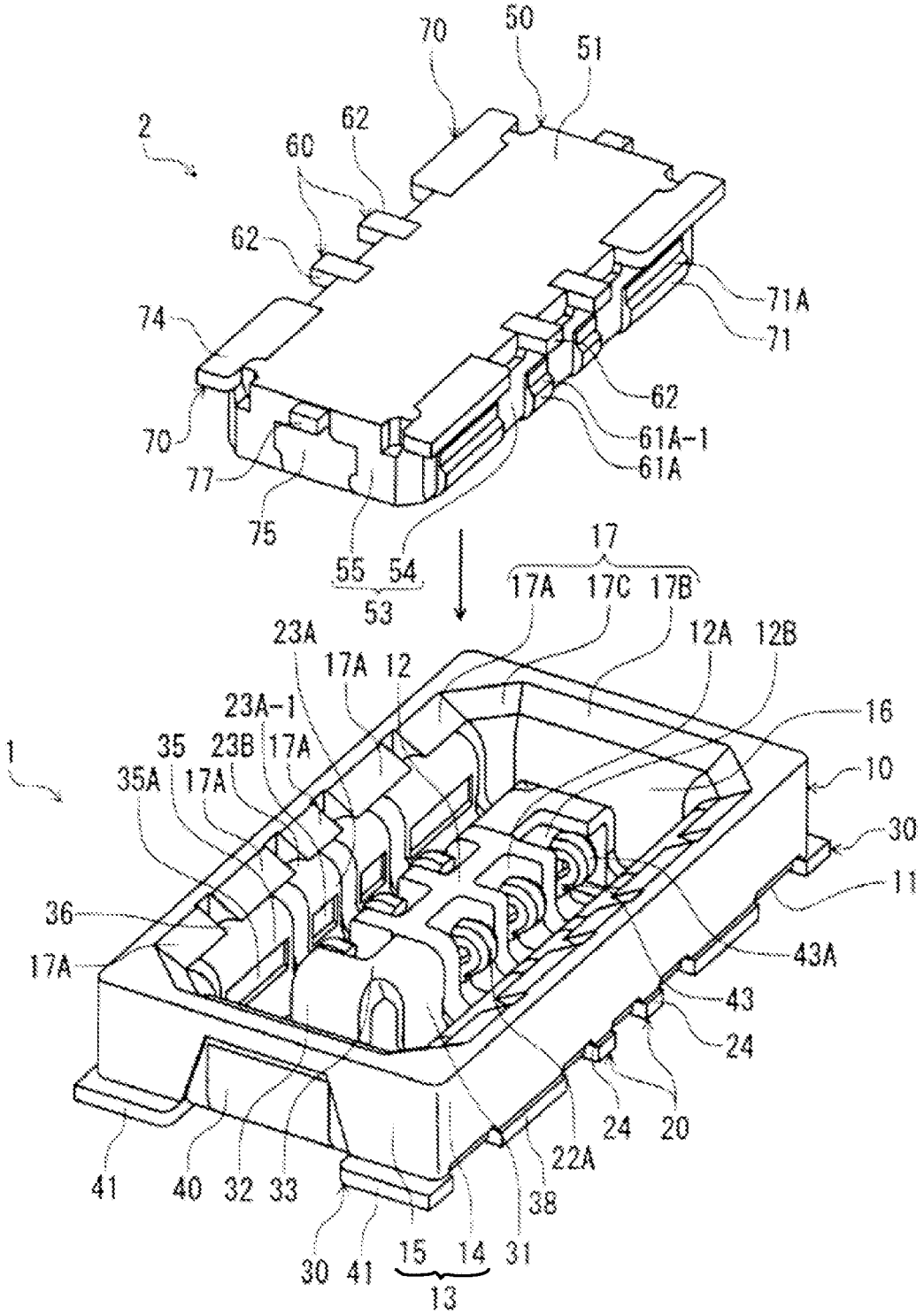
FIG. 1 An oblique view of a receptacle connector and a plug connector mated therewith from above according to a first embodiment of the present invention, illustrating a state prior to connector mating.

FIG. 1 is an oblique view of receptacle connector 1, which is used as a first electrical connector according to the first embodiment of the present invention, and plug connector 2, which is used as a second electrical connector, mated therewith from above. The drawing illustrates a state prior to connector mating. The receptacle connector 1 and plug connector 2 according to the present embodiment are electrical connectors for circuit boards that are disposed on the mounting faces of respective circuit boards (not shown) and form a connector assembly in which the direction of insertion and extraction is the direction of diametrical opposition of the circuit boards (vertical direction in FIG. 1). In the discussion of this embodiment, the direction of mating of the plug connector 2 with the receptacle connector 1, that is, the direction of downward movement of the plug connector 2 in FIG. 1, is described as the "direction of connector mating", while the opposite direction, in other words, the upwardly facing direction of FIG. 1, is described as the "direction of connector extraction". In addition, the direction of extraction and the direction of mating of the receptacle connector 1, which serves as a mating connector for the plug connector 2, are directions respectively opposite to the "direction of connector mating" and the "direction of connector extraction" of the above-mentioned plug connector 2.

[Configuration of Receptacle Connector 1]

As seen in FIG. 1, the receptacle connector 1 has a housing 10, which has a substantially rectangular parallelepiped-like external configuration; multiple receptacle signal terminals 20 (hereinafter referred to simply as "receptacle terminals 20") retained in array form by unitary co-molding with said housing 10, with the array direction being the longitudinal direction of the housing 10, which is parallel to the above-mentioned mounting faces; and receptacle lock fittings 30 retained in place by unitary co-molding with the respective end portions of the housing 10 in the above-mentioned array direction.

As seen in FIG. 1, the receptacle terminals 20 are provided in a region in the vicinity of the center of the housing 10 in the above-mentioned array direction such that they form two symmetrical rows in the connector width direction, with two terminals arranged in each row, as in the example shown. In addition, the receptacle lock fittings 30 are provided at the end portions of the housing 10 at two external locations relative to the array region of the receptacle terminals 20 in the above-mentioned array direction. The receptacle connector 1 is disposed and mounted on a circuit board in the orientation illustrated in FIG. 1.

As seen in FIG. 1, the housing 10 is made of resin or another electrically insulating material and has a bottom wall 11, which has a bottom face parallel to the mounting face of the circuit board (not shown) that serves as a mounting surface and which extends such that the above-mentioned array direction is its longitudinal direction, a protruding wall 12, which rises up from the bottom wall 11 while extending in the above-mentioned array direction, and a perimeter wall 13, which rises up from the bottom wall 11 and surrounds the protruding wall 12. Said perimeter wall 13 has two lateral walls 14, which are in a mutually opposing relationship and extend in the above-mentioned array direction, and two end walls 15, which couple the end portions of said two lateral walls 14 and extend in the connector width direction (transverse direction of the housing 10) perpendicular to the above-mentioned array direction. An upwardly open quadrangular annular space between the perimeter wall 13 and the protruding wall 12 forms a recessed mating portion 16 used to receive a mating portion of the plug connector 2.

The protruding wall 12 has formed therethrough signal terminal groove portions 12A at locations that correspond to the receptacle terminals 20 in the above-mentioned array direction, and, in addition, power supply terminal groove portions 12B at locations that correspond to the hereinafter described power supply contact arm portions provided in the receptacle lock fittings 30, with said portions being sunk into the lateral faces of the protruding wall 12 (faces perpendicular to the connector width direction) and extending in the vertical direction (in addition, see power supply terminal groove portions 12B in FIGS. 7 (A) and (B)). As seen in FIG. 1, the signal terminal groove portions 12A are formed in the lateral faces on both sides of the protruding wall 12 and the power supply terminal groove portions 12B are formed in the lateral faces on one side of the protruding wall 12. In addition, the power supply terminal groove portion 12B provided at one end of the protruding wall 12 in the above-mentioned array direction and the power supply terminal groove portion 12B provided at the other end are formed in mutually opposed lateral faces. The signal terminal groove portions 12A contain the hereinafter described signal contact arm portions 22 of the receptacle terminals 20, while the hereinafter described power supply contact arm portions 43 of the receptacle lock fittings 30 are contained in the power supply terminal groove portions 12B.

Guide faces 17, which slope downwardly toward recessed mating portion 16, are formed in the top portion of the inner surface (surface located proximate to recessed mating portion 16) of the perimeter wall 13. Said guide faces 17 have lateral guide faces 17A, which are formed on the inner surface of the lateral walls 14, end guide faces 17B, which are formed on the inner surface of the end walls 15, and corner guide faces 17C, which are formed on the inner surface of the interfacing sections between the lateral walls 14 and end walls 15. As seen in FIG. 1, the lateral guide faces 17A are formed in an intermittent manner at multiple locations on the lateral walls 14 in above-mentioned array direction. The end guide faces 17B are formed as a single surface extending in the connector width direction of the end walls 15. The corner guide faces 17C couple the above-mentioned end guide faces 17B and the lateral guide faces 17A at the outermost locations in the above-mentioned array direction.

Figure 2:
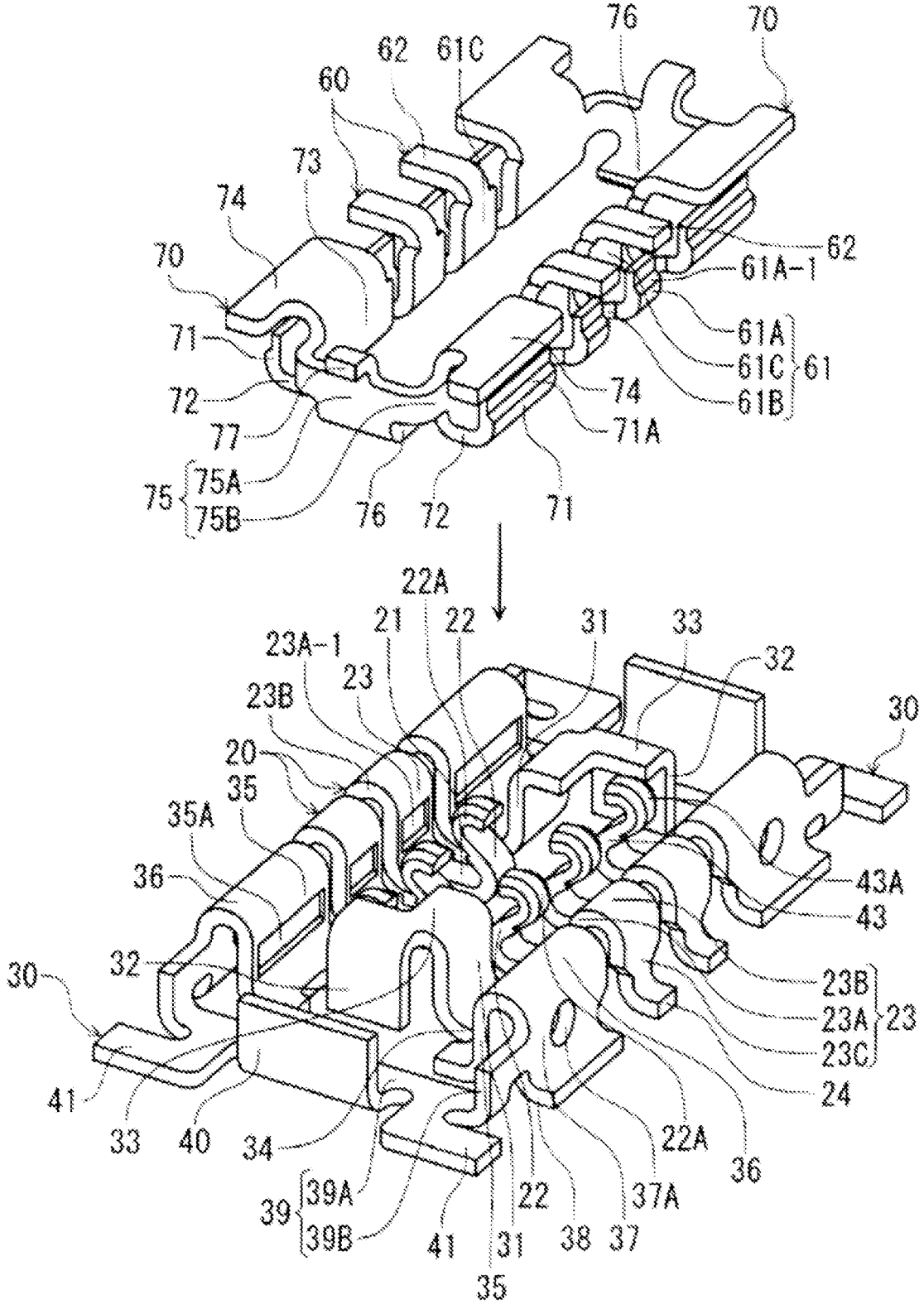
FIG. 2 An oblique view illustrating the receptacle connector and plug connector of FIG. 1 with the housing omitted.
Figure 3:
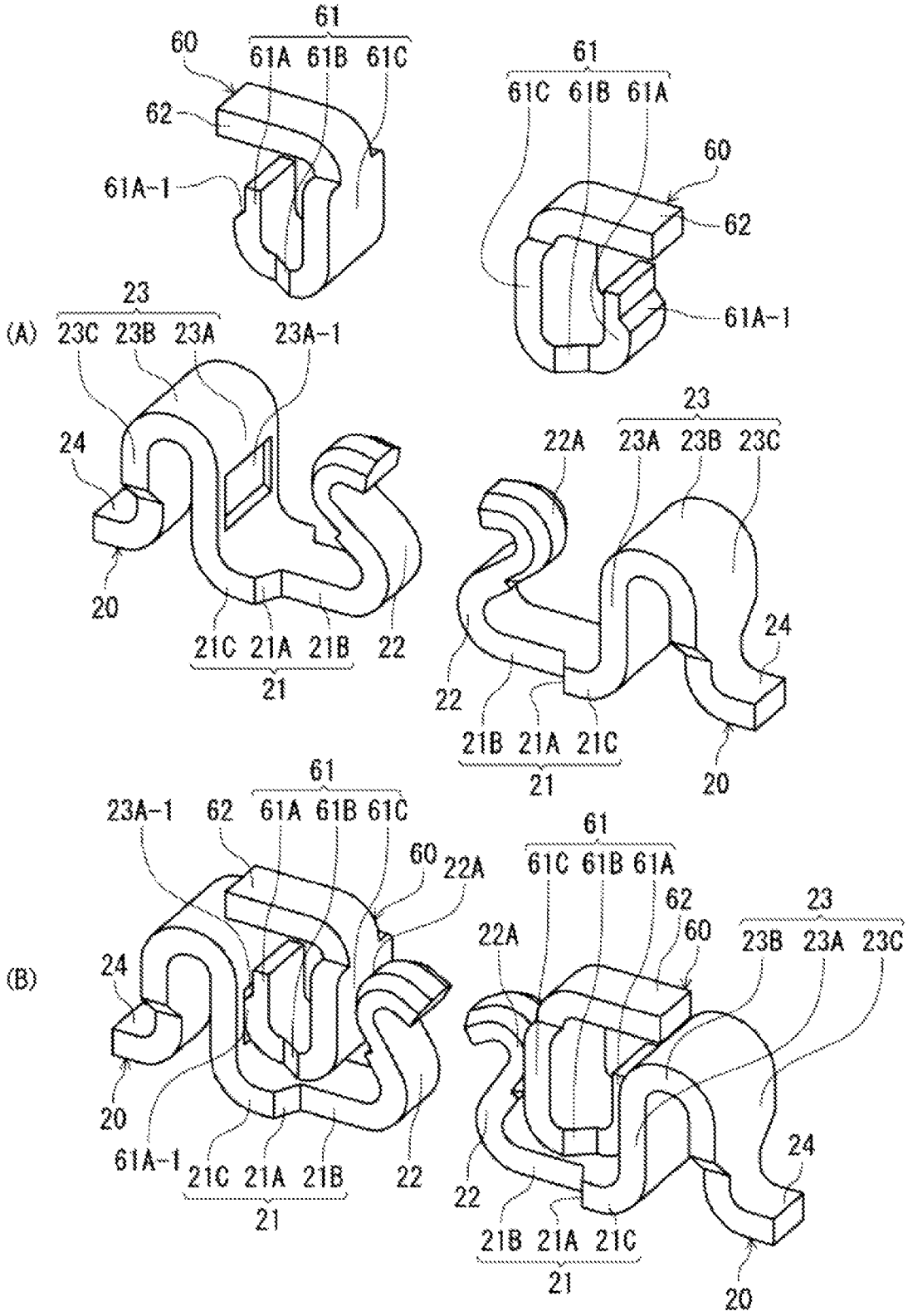
FIG. 3 An oblique view illustrating the plug terminals of the plug connector and the receptacle terminals of the receptacle connector of FIG. 1, wherein (A) illustrates a state prior to connector mating and (B) illustrates a state after connector mating.

FIG. 2 is an oblique view illustrating the receptacle connector 1 and the plug connector 2 of FIG. 1 with the housing 10 omitted. In addition, FIG. 3 is an oblique view illustrating the plug terminals 60 of the plug connector 2 and the receptacle terminals 20 of the receptacle connector 1 of FIG. 1, wherein (A) illustrates a state prior to connector mating and (B) illustrates a state after connector mating. The configuration of the receptacle terminals 20 is described below with reference to FIGS. 1-3, and particularly FIG. 3.

A receptacle terminal 20 has a bottom base portion 21, which is made by bending a strip-shaped sheet metal piece in the sheet thickness direction and which extends in the connector width direction along the bottom wall 11 of the housing, a signal contact arm portion 22, which extends upwardly from the end portion of said bottom base portion 21 proximate to the protruding wall 12, an inverted U-shaped retained portion 23, which first extends upwardly at the end portion of the bottom base portion 21 proximate to the lateral wall 14 and then folds back downwardly, and a connecting portion 24, which extends outwardly in the connector width direction from the lower end of said retained portion 23.

The bottom base portions 21 extend throughout the connector width extent, which includes the recessed mating portion 16. The upper surface of said bottom base portions 21 is exposed to the recessed mating portion 16 and they are retained in place by unitary co-molding with the bottom wall 11 (see FIGS. 6 (A) and (B)). As seen in FIG. 3 (A), the bottom base portions 21 have stepped portions 21A formed in the two lateral edge portions at intermediate positions in the connector width direction, such that the section that is closer to the signal contact arm portion 22 than said stepped portions 21A constitutes a narrow portion 21B, which has smaller width dimensions, and the section that is closer to the retained portion 23 than the above-mentioned stepped portions 21A constitutes a wide portion 21C, which has width dimensions larger than those of the above-mentioned narrow portion 21B.

As seen in FIGS. 3 (A) and (B), the signal contact arm portion 22 is formed to have the same width dimensions as the narrow portion 21B of the bottom base portion 21 throughout the entire length. In addition, the width dimensions of said signal contact arm portion 22 are smaller than the width dimensions of the retained portion 23 (except for the bottom portion of the hereinafter described external arm portion 23C) and the width dimensions of the internal arm portion 61C formed in the hereinafter described plug terminals 60. In addition, as a result of forming the signal contact arm portion 22 to have small width dimensions in this manner, said signal contact arm portion 22 is likely to be subject to elastic displacement. It is not essential for the width dimensions of the signal contact arm portion 22 to be the same as the width dimensions of the narrow portion 21B of the bottom base portion 21 throughout the entire length of said signal contact arm portion 22 and, for example, the signal contact arm portion 22 may be formed to become gradually smaller toward the free end thereof.

The signal contact arm portions 22 are contained in the signal terminal groove portions 12A of the protruding wall 12 and are elastically displaceable in their sheet thickness direction (connector width direction). In addition, the signal contact arm portions 22 have their upper end sections (i.e. their free ends) convex-curved toward the inner surface of the lateral wall 14, and these convex-curved sections are formed as signal contact protrusions 22A used to provide contact with the plug terminals 60 of the hereinafter described plug connector 2. When the signal contact arm portions 22 are in a free state, said signal contact protrusions 22A protrude from the signal terminal groove portions 12A and are positioned inside the recessed mating portion 16 (see FIG. 6 (A)).

The retained portions 23 have internal arm portions 23A, which extend upwardly from the end portions of the base bottom portions 21 proximate to said lateral wall 14 along the inner surface of the lateral wall 14, transitional portions 23B, which continue from the upper end of said internal arm portions 23A and are bent so as to fold back downwardly at a more external location in the connector width direction than said internal arm portions 23A, and external arm portions 23C, which extend downwardly via said transitional portions 23B, and are retained in place by unitary co-molding with the lateral walls 14. As seen in FIG. 1, the upper ends of said retained portions 23, in other words, the upper ends of the transitional portions 23B, are located at practically the same height as the lower edges of the lateral guide faces 17A in the vertical direction. As seen in FIG. 3 (A), the retained portions 23, with the exception of the bottom portion of the external arm portions 23C, are formed to have the same width dimensions as the wide portions 21C of the previously described bottom base portions 21, in other words, dimensions that are larger than those of the signal contact arm portions 22.

As seen in FIG. 1, the internal arm portions 23A of the retained portions 23 have their major surfaces exposed to the recessed mating portion 16, and rectangular lock portions 23A-1, which are sunk into said major surfaces, are formed therein. Said lock portions 23A-1 are formed, for example, by press-forming and the like, and their width dimensions (dimensions in the above-mentioned array direction) are smaller than the width dimensions of the internal arm portions 23A. As a result of engagement with lockable portions 61A-1 in the plug terminals 60 of the hereinafter described plug connector 2, said lock portions 23A-1 maintain the connectors in a mated state and prevent disengagement of the connectors while at the same time contacting and providing electrical communication during engagement with the lockable portions 61A-1, thereby also serving to assist the above-mentioned signal contact protrusions 22A.

In this embodiment, the internal arm portions 23A of the retained portions 23, which are secured to the lateral wall 14, along with the bottom base portions 21 and the signal contact arm portions 22, which are elastically displaceable elastic arm portions, form upwardly open U-shaped sections, and said U-shaped sections serve as receiving portions used to receive the nesting portions 61 of the plug terminals 60, which will be described below.

As seen in FIG. 1, the upper surface of the transitional portions 23B of the retained portions 23 is partially exposed between the lateral guide faces 17A of the housing 10. In addition, the external arm portions 23C of the retained portions 23 are embedded and retained in said lateral walls 14 without being exposed on the lateral walls 14 of the housing 10. As best seen in FIGS. 3 (A) and (B), the width dimensions (dimensions in the above-mentioned array direction) of said external arm portion 23C become smaller at an intermediate position near its lower end as it extends downward. As a result, the bottom portion (section positioned below the above-mentioned intermediate position) of the external arm portion 23C is formed to have the same width dimensions as the signal contact arm portion 22.

As seen in FIG. 3 (A), the connecting portion 24, which is formed to have the same width dimensions as the signal contact arm portion 22 and is at the same height level as the bottom base portion 21, extends directly from the lower end of the external arm portion 23C outwardly in the connector width direction up to almost the same position as the external surface of the lateral wall 14. Said connecting portion 24 has its bottom face exposed on the bottom wall 11 of the housing 10 (see FIGS. 6 (A) and (B)) and is solder-connected to the corresponding signal circuitry on the circuit board. In addition, it is not essential for the width dimensions of the connecting portion 24 to be the same as the width dimensions of the signal contact arm portion 22, and different width dimensions can be used.

The width dimensions of the thus configured receptacle terminals 20 are largest in the retained portions 23 (except for the bottom portion of the external arm portion 23C). As previously discussed, in this embodiment, the signal contact arm portions 22 of the receptacle terminals 20, which are brought into contact with the plug terminals 60, are formed to have smaller width dimensions in the above-mentioned array direction than the internal arm portions 23A of the retained portions 23. Therefore, for the mutually adjacent receptacle terminals 20 that are arranged in the housing 10, the spacing between the signal contact arm portions 22 is larger than the spacing between the internal arm portions 23A. As a result, the adjacent signal contact arm portions 22 are positioned to provide large gaps therebetween, which makes it possible to minimize the above-mentioned electrical signal interference between the receptacle terminals 20 when electrical signals flow between the signal contact protrusions 22A and the connecting portions 24.

In addition, in this embodiment, not only are the signal contact arm portions 22 formed to have small dimensions, but the narrow portions 21B of the bottom base portions 21, the bottom portions of the external arm portions 23C, and the connecting portions 24 are also formed to have small width dimensions. Accordingly, within the range comprising these sections, the spacing between the adjacent receptacle terminals 20 can also be made larger, thereby providing for further suppression of electrical signal interference.

Figure 4:
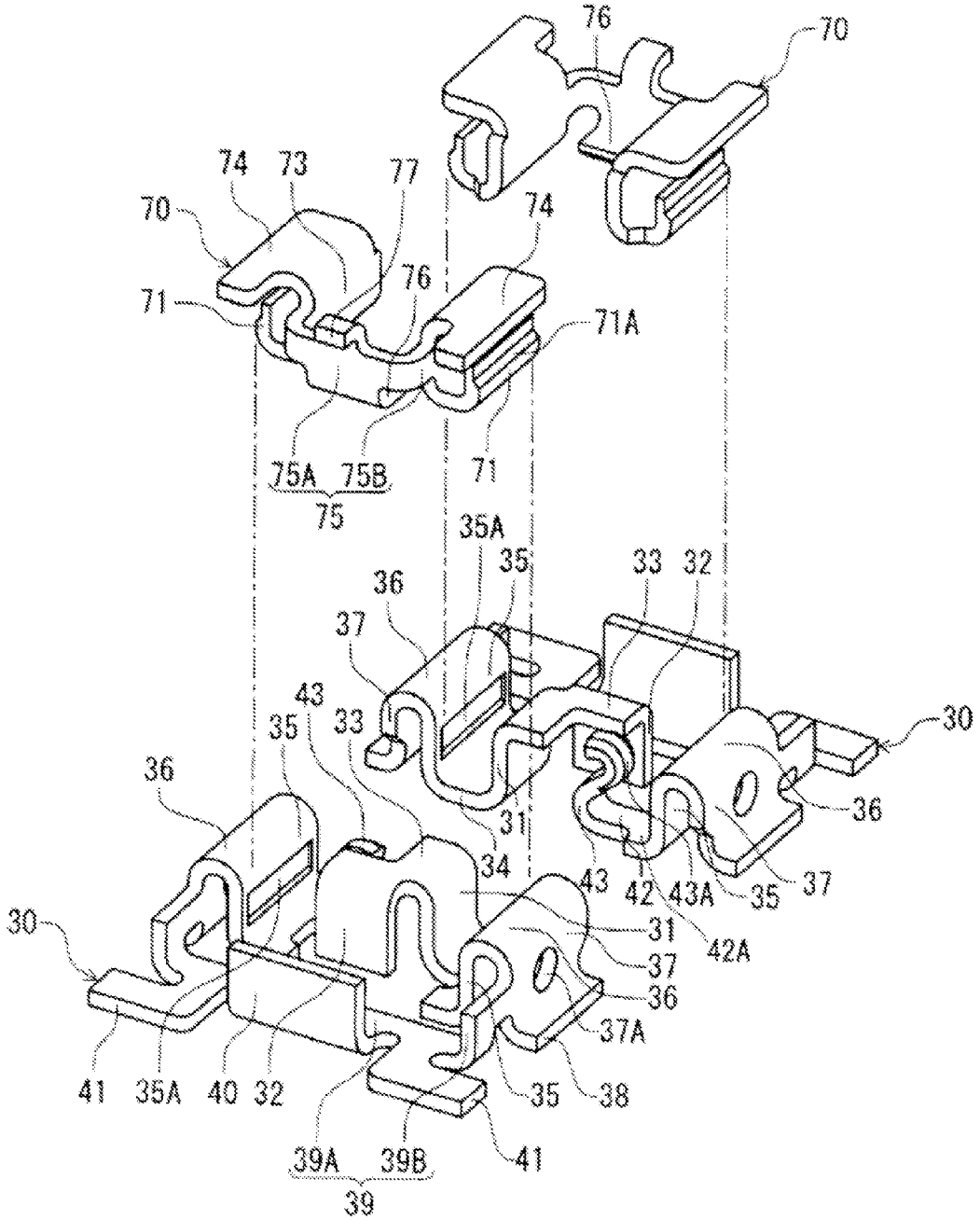
FIG. 4 An oblique view illustrating the plug lock fittings of the plug connector and the receptacle lock fittings of the receptacle connector of FIG. 1.

Next, the configuration of the receptacle lock fittings 30 will be described with reference to FIGS. 1, 2, and 4. FIG. 4 is an oblique view illustrating the receptacle lock fittings 30 of the receptacle connector 1 of FIG. 1 and the plug lock fittings 70 of the plug connector 2. In this embodiment, the receptacle lock fittings 30 function not only as lock fittings, but also, as discussed below, possess a power supply terminal functionality. However, it is not essential for the receptacle lock fittings 30 to be provided with the power supply terminal functionality.

The receptacle lock fittings 30 are made by bending sheet metal members in the sheet thickness direction and, when viewed from above, can be roughly divided into sections positioned in corresponding alignment with the protruding wall 12, sections positioned in corresponding alignment with each of the two lateral walls 14, sections positioned in corresponding alignment with the end walls 15, and sections positioned in corresponding alignment with the recessed mating portion 16.

As seen in FIG. 1, the sections of the receptacle lock fittings 30 that are positioned in corresponding alignment with the protruding wall 12 of the housing 10 have lateral upright face-reinforcing plate portions 31, which extend along a lateral face serving as an upright face of the protruding wall 12 (the face parallel to the array direction), end upright face-reinforcing plate portions 32, which extend along an end face serving as another upright face of the protruding wall 12 (the face perpendicular to the array direction), top face-reinforcing plate portions 33, which extend along the top face (upper surface) of the protruding wall 12, and power supply contact arm portions 43, which extend upwardly from the hereinafter-described extension portion 42 extending along the bottom wall 11 of the housing 10 inside the power supply terminal groove portion 12B of the protruding wall 12.

As seen in FIG. 1, when the top face of the end portions of the protruding wall 12 is viewed from above, the top face-reinforcing plate portions 33 extend in an L-shaped configuration positioned so as to avoid the area of the power supply terminal groove portions 12B on said top face, and, as seen in FIG. 1 and FIG. 2, they couple the upper ends of the lateral upright face-reinforcing plate portions 31 and the end upright face-reinforcing plate portions 32. The lateral upright face-reinforcing plate portions 31, end upright face-reinforcing plate portions 32, and top face-reinforcing plate portions 33, which have their major surfaces exposed, respectively, on the lateral face, end face, and top face of the protruding wall 12 of the housing 10, are retained in place on said protruding wall 12. Since in this embodiment the lateral upright face-reinforcing plate portions 31, end upright face-reinforcing plate portions 32, and top face-reinforcing plate portions 33 respectively cover the lateral face, end face, and top face of the protruding wall 12, the lateral face, end face, and top face of the protruding wall 12 can be protected from damage due to collision with the plug connector in the process of connector insertion and extraction. Among the sections positioned in corresponding alignment with the protruding wall 12 of the housing 10, the power supply contact arm portion 43 will be described below.

The sections of the receptacle lock fittings 30 that are positioned in corresponding alignment with the lateral walls 14 of the housing 10 have lock plate portions 35, which extend along the inner surface of said lateral walls 14, transitional portions 36, which are bent so as to fold back downwardly from the upper end of said lock plate portions 35, lateral retained portions 37, which extend downwardly via said transitional portions 36 and through the lateral walls 14, and lateral securing portions 38, which extend outwardly in the connector width direction from the lower edge of said lateral retained portions 37. The lock plate portions 35 are retained in place on said lateral walls 14, with their major surfaces located proximate to the recessed mating portion 16 of the housing 10 exposed on the inner surfaces of the lateral walls 14, and rectangular lock portions 35A, which are sunk into their exposed major surfaces, are formed therein.

The transitional portions 36 are upwardly convex-curved and, as seen in FIG. 1, a portion of their upper surface is exposed between the lateral guide faces 17A of the housing 10. As seen in FIG. 2, the lateral retained portions 37 have an opening 37A formed therethrough in the sheet thickness direction, and, as a result of resin flowing into said openings 37A during unitary co-molding with the housing 10 seen in FIG. 1, the housing 10 can retain the receptacle lock fittings 30 more securely. The lateral retained portions 37 are embedded and retained in the lateral walls 14 without being exposed on said lateral walls 14.

As seen in FIG. 1, the lateral securing portions 38 are exposed on the bottom wall 11 of the housing 10 and are secured by solder-connecting their lower surfaces of said lateral securing portions 38 to the corresponding power supply circuitry of the circuit board. Said lateral securing portions 38 extend in the connector width direction up to almost the same position as the external surface of the lateral walls 14.

The sections of the receptacle lock fittings 30 that are positioned in corresponding alignment with the end walls 15 of the housing 10 have coupling portions 39, which extend in the connector width direction and couple the side edge portions (the edge portions extending in the vertical direction) of the lateral retained portions 37, end retained portions 40, which extend upwardly along the external surface of the end walls 15 from said coupling portions 39 at intermediate locations between said coupling portions 39 in the connector width direction, and end securing portions 41, which extend outwardly in the array direction from said coupling portions 39 along the bottom wall 11 of the housing 10 and then outwardly in the connector width direction at locations in the vicinity of the two ends of the coupling portions 39 in the connector width direction.

The coupling portions 39 have coupling base portions 39A, which have major surfaces parallel to the bottom wall 11 of the housing 10 (perpendicular to the vertical direction) and which extend in the connector width direction, and coupling end portions 39B, which are bent and extend upwardly at both ends of said coupling base portions 39A. The coupling base portions 39A extend along the bottom wall 11 and are retained in place on said bottom wall 11 of the housing 10. The coupling end portions 39B, which are provided at the same locations in the connector width direction as the lateral retained portions 37, are embedded and retained in the lateral walls 14 without being exposed on said lateral walls 14. Although in this embodiment the coupling portions 39 couple the lateral retained portions 37, they may be used instead, for example, to couple the lock plate portions 35.

Of the two side edge portions (edge portions extending in the connector width direction) of the coupling base portions 39A, the end retained portions 40 extend upwardly from the side edge portion that is located on the outside in the above-mentioned array direction. The end retained portions 40 have their major surfaces exposed on the external surfaces of the end walls 15 of the housing 10 and retained in place on said end walls 15. The end securing portions 41, which are located at the two lateral positions of the end retained portions 40, extend outwardly in the above-mentioned array direction from the side edge portions of the coupling base portions 39A located on the outside in the above-mentioned array direction and then extend outwardly in the connector width direction, and have an L-shaped configuration when viewed from above. As seen in FIG. 1, the end securing portions 41 are exposed on the bottom wall 11 of the housing 10 and are secured by solder-connecting the lower surfaces of said end securing portions 41 to the corresponding portions of the circuit board. Said end securing portions 41 extend in the connector width direction up to almost the same position as the external surface of the lateral walls 14.

The sections of the receptacle lock fittings 30 positioned in corresponding alignment with the recessed mating portion 16 of the housing 10 have a connecting bottom portion 34 that connects the lower end portion of the lateral upright face-reinforcing plate portion 31 and the lower end portion of a lock plate portion 35 facing said lateral upright face-reinforcing plate portion 31, and extension portion 42 that connects the lower end portion of the power supply contact arm portion 43 and the lower end portion of other lock plate portion 35 facing the power supply contact arm portion 43. The connecting bottom portion 34 and extension portion 42 extend along the bottom wall 11 in the connector width direction and are retained in place on said bottom wall 11 with their upper surfaces exposed to the recessed mating portion 16.

The extension portion 42 extends from the lower edge of the lock plate portion 35 toward the protruding wall 12 at the same location as the power supply terminal groove portion 12B of the protruding wall 12 in the above-mentioned array direction. As seen in FIG. 4, said extension portion 42 is formed to have small width dimensions in the section that does not include the end portion on the side connected to the lock plate portion 35 (hereinafter referred to as "extension base portion 42A"). In other words, in said extension portion 42, the extension base portion 42A has the largest width dimensions. It should be noted that when the receptacle lock fittings 30 are not provided with power supply terminal functionality, the extension portions 42 may be omitted.

In addition, among the sections of the receptacle lock fittings 30 positioned in corresponding alignment with the protruding wall 12 of the housing 10, the power supply contact arm portion 43 is a continuation of the above-mentioned extension portion 42 and extends upwardly inside the power supply terminal groove portion 12B of the protruding wall 12. Said power supply contact arm portion 43 is positioned to be aligned with the signal contact arm portions 22 of the receptacle terminals 20 and may be brought into contact with the internal plate portions 73 provided in the hereinafter described plug lock fitting 70, and may serve as corresponding power supply contact portions under a contact pressure as a result of elastic displacement in the sheet thickness direction (connector width direction) (see FIG. 7 (B)). Said power supply contact arm portion 43 has its upper end section (i.e. its free end) convex-curved toward the inner surface of the lateral walls 14, and is formed as a power supply contact protrusion 43A used to provide contact between its convex-curved sections and the above-mentioned internal plate portion 73. In a free state, the power supply contact protrusion 43A of the power supply contact arm portion 43 protrudes from the power supply terminal groove portion 12B of the housing 10 and is positioned inside the recessed mating portion 16 (see FIG. 7 (A)).

As seen in FIG. 2, the power supply contact arm portion 43 of the receptacle lock fitting 30 is formed to have the same shape and the same width dimensions as the signal contact arm portion 22 of the receptacle terminals 20. In addition, the width dimensions of said power supply contact arm portion 43 are equal to the width dimensions of the previously described extension portion 42 (except for the extension base portion 42A) throughout its entire length and smaller than the width dimensions of the extension base portion 42A of said extension portion 42 (see also FIG. 4). Therefore, due to the fact that large gaps are formed between said power supply contact arm portions 43 and signal contact arm portions 22 adjacent to said power supply contact arm portions 43 in the array direction, electrical signal interference between the receptacle terminals 20 and the receptacle lock fittings 30 can be accordingly minimized. In addition, as a result of forming the power supply contact arm portion 43 to have small width dimensions in this manner, said power supply contact arm portion 43 is likely to be subject to elastic displacement. It is not essential for the width dimensions of the power supply contact arm portion 43 to be the same as the width dimensions of the extension portion 42 (except for the extension base portion 42A) throughout the entire length of said power supply contact arm portion 43, and, for example, the power supply contact arm portion 43 may be formed to become gradually smaller toward its free end. It should be noted that when the receptacle lock fittings 30 are not provided with power supply terminal functionality, the power supply contact arm portions 43 are omitted.

In addition, in this embodiment, not only are the power supply contact arm portions 43 formed to have small width dimensions, but the extension portions 42 are also formed to have small width dimensions within the range that does not include the above-mentioned extension base portions 42A. Therefore, within the above-mentioned range comprising said extension portions 42, it is also possible to form large gaps between the bottom base portions 21 of the adjacent receptacle terminals 20, which provides for further suppression of electrical signal interference.

[Configuration of Plug Connector 2]

Figure 5:
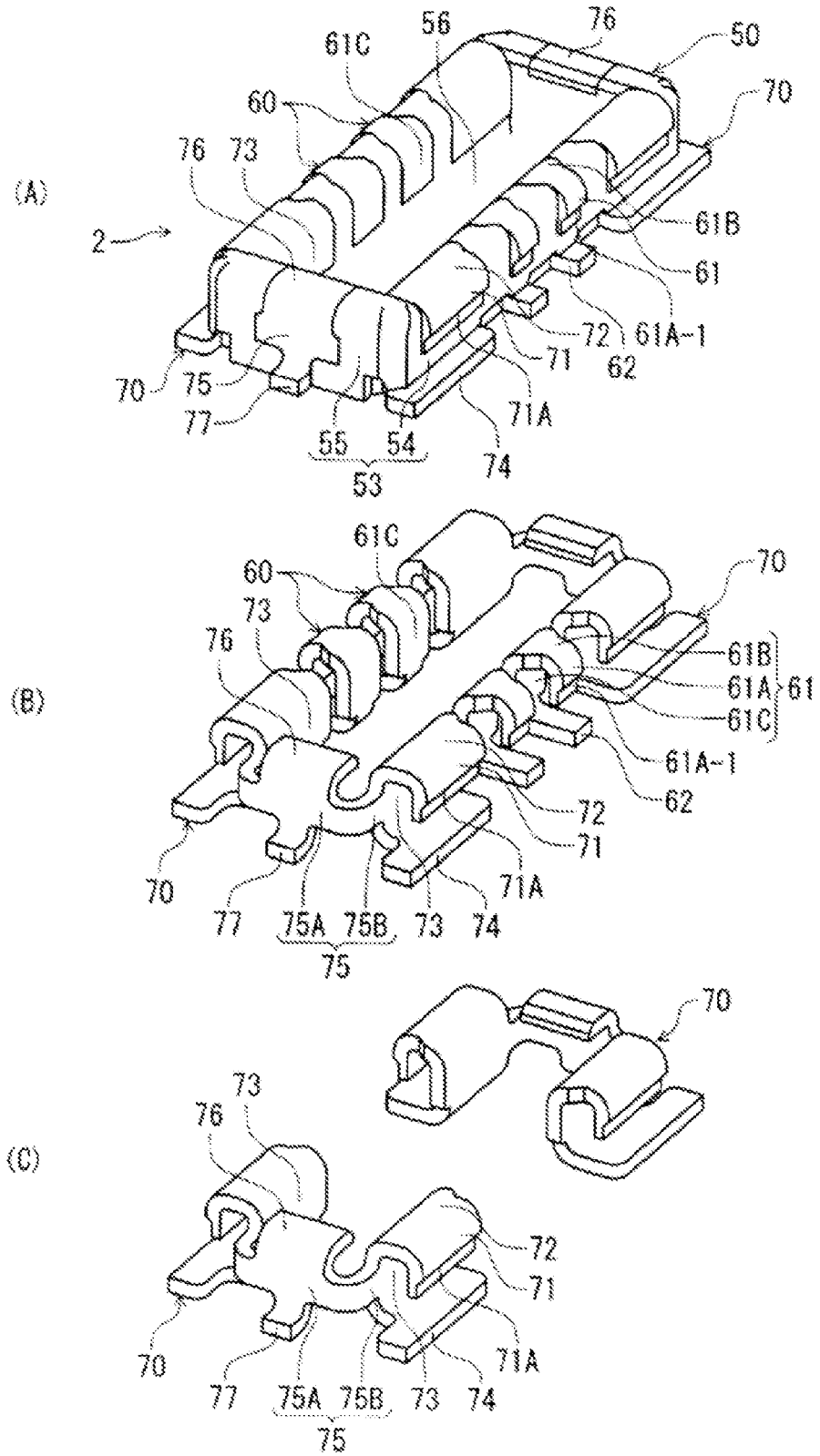
FIG. 5 (A) is an oblique view illustrating the plug connector of FIG. 1 after turning it over, (B) is an oblique view illustrating the plug connector of (A) with the housing omitted, and (C) is an oblique view illustrating only the plug lock fittings of the plug connector of (A).

Next, the configuration of plug connector 2 will be described with reference to FIGS. 1-5 (A-C). FIG. 5 (A) is an oblique view illustrating the plug connector 2 of FIG. 1 after turning it over, FIG. 5 (B) is an oblique view illustrating the plug connector 2 of FIG. 5 (A) with its housing 50 omitted, and FIG. 5 (C) is an oblique view illustrating only the plug lock fittings 70 of the plug connector 2 of FIG. 5 (A).

The plug connector 2 has a frame-shaped mating portion adapted for recessed mating portion 16 of the receptacle connector 1 (see FIG. 5 (A)) and the connectors 1 and 2 are configured to be mated by nesting said mating portion into the recessed mating portion 16. The plug connector 2 has a housing 50 with a substantially rectangular parallelepiped-like external configuration, plug lock fittings 70, and multiple plug signal terminals 60 (hereinafter referred to simply as "plug terminals 60") retained in an array form on said housing 50 by unitary co-molding therewith such that the array direction is the longitudinal direction of the housing 50 parallel to the mounting face of the circuit board (not shown).

The housing 50 is made from resin or another electrically insulating material and, as seen in FIG. 1, has a bottom wall 51, which has a bottom face parallel to the mounting face of the circuit board (not shown), which serves as a mounting surface and which extends such that the above-mentioned array direction is the longitudinal direction, and a perimeter wall 53, which serves as a mating portion and protrudes downwardly in FIG. 1 (upwardly in FIG. 5 (A)) from said bottom wall 51. As seen in FIG. 5 (A), said perimeter wall 53 has two lateral walls 54, which are in a mutually opposing relationship and extend in the above-mentioned array direction, and two end walls 55, which couple the end portions of said two lateral walls 54 and extend in the connector width direction (transverse direction of the housing 50) perpendicular to the above-mentioned array direction. The space that is surrounded by the perimeter wall 53 and is open downwardly in FIG. 1 (upwardly in FIG. 5 (A)) forms a recessed mating portion 56 (see FIG. 5 (A)) used to receive the protruding wall 12 of the receptacle connector 1.

The plug terminals 60 are provided in a region in the vicinity of the center of the housing 50 in the above-mentioned array direction such that they form two symmetrical rows in the connector width direction, with two terminals arranged in each row, as in the example shown. Said plug terminals 60 are made by bending strip-shaped sheet metal pieces in the sheet thickness direction and, as best seen in FIGS. 3 (A) and (B), have U-shaped nesting portions 61, which are retained in place on the lateral walls 54 of the housing 50, and connecting portions 62, which extend outwardly in the connector width direction from the upper end in FIGS. 3 (A) and (B) (lower end in FIG. 5 (B)) of the arm portion on one side (hereinafter described internal arm portion 61C) located proximate to the recessed mating portion 56 of the two arm portions of said nesting portions 61 and are connected to the corresponding signal circuitry of the circuit board. The plug terminals 60 are retained in place on the nesting portions 61 as a result of unitary co-molding with the housing 50.

The nesting portions 61 are sections nested between the two arm portions provided in the U-shaped receiving portions of the receptacle terminals 20 of the receptacle connector 1 (i.e., the signal contact arm portion 22 and the internal arm portion 23A) when the connectors are in a mated state. They are embedded in the lateral walls 54 of the housing 50 so as to stride said lateral walls 54 from below (from above in FIGS. 5 (A) and (B)). As best seen in FIGS. 3(A) and (B), said nesting portions 61 have an external arm portion 61A that extends downwardly along the external surface of the lateral wall 54, a transitional portion 61B that is bent so as to fold back upwardly from the lower end of said external arm portion 61A at an internal location in the connector width direction, and an internal arm portion 61C that extends upwardly after passing through said transitional portion 61B (see FIGS. 6 (A) and (B)). The dimensions of the nesting portions 61 in the connector width direction are slightly larger than the spacing between the signal contact protrusions 22A of the receptacle terminals 20 and the internal arm portions 23A facing said signal contact protrusions 22A.

As seen in FIGS. 3 (A) and (B), the external arm portion 61A of the nesting portion 61, which is positioned so as to correspond to the internal arm portion 23A of the receptacle terminal 20, is formed to have width dimensions smaller than the internal arm portion 61C of the above-mentioned nesting portion 61 as well as the internal arm portion 23A of the receptacle terminal 20. As seen in FIG. 1, the external arm portion 61A has its major surface exposed on the external surface of the lateral wall 54 and, on this exposed major surface, there is formed a lockable portion 61A-1, which has a stepped shape formed therein by sinking into the top portion of said major surface. Said lockable portion 61A-1, which extends throughout the entire width (in the above-mentioned array direction) of said external arm portion 61A, is adapted to engage with the lock portion 23A-1 of the receptacle terminal 20 in the direction of connector extraction.

As previously discussed, the external arm portion 61A of the plug terminal 60 is positioned in corresponding alignment with the internal arm portion 23A of the receptacle terminal 20 and the width dimensions of said external arm portion 61A are smaller than the internal arm portion 23A of the receptacle terminals 20. Further, in this embodiment, a lock portion 23A-1 is formed as a recessed portion in the internal arm portion 23A of the receptacle terminal 20, which has larger width dimensions, and a lockable portion 61A-1 is formed as a stepped portion in the external arm portion 61A of the plug terminal 60, which has smaller width dimensions. Thus, in this embodiment, the lock portion 23A-1, which is a recessed portion, is provided not in the external arm portion 61A of the plug terminal 60, which has smaller width dimensions, but in the internal arm portion 23A of the receptacle terminal 20, which has larger width dimensions, and therefore, the width dimensions of said lock portion 23A-1, that is, the recessed portion, can be accordingly increased. As a result, by maximizing the width dimensions of the lock portion 23A-1, large engageable width dimensions can be ensured for the lock portion 23A-1 and lockable portion 61A-1, which accordingly makes it possible to improve locking strength.

According to this embodiment, although a lockable portion 61A-1 in the form of a stepped portion, which extends over the entire width of said external arm portion 61A, is formed in the external arm portion 61A of the plug terminal 60, alternatively, the lockable portion may be in the form of a protrusion that protrudes from the major surface in a region that is intermediate in the width direction of the external arm portion 61A, so long as sufficient engageable width dimensions are ensured. In addition, although according to this embodiment, a lock portion 23A-1 in the form of a recessed portion is formed in the internal arm portion 23A of the receptacle terminal 20 and a lockable portion 61A-1 in the form of a stepped portion is formed in the external arm portion 61A of the plug terminal 60, alternatively, as long as sufficient mutually engageable width dimensions are ensured, a lock portion in the form of a protrusion or a stepped portion may be formed in the internal arm portion 23A of the receptacle terminal 20 and a lockable portion in the form of a recessed portion may be formed in the external arm portion 61A of the plug terminal 60.

As seen in FIGS. 3(A) and (B), the transitional portion 61B of the nesting portion 61 extends in the connector width direction, with its width dimensions (dimensions in the above-mentioned array direction) increasing from the lower end of the external arm portion 61A toward the lower end of the internal arm portion 61C. The lower surface, as shown in FIG. 1 (upper surface in FIG. 5 (A)), of said transitional portion 61B is exposed on the lateral wall 54.

As seen in FIGS. 3 (A) and (B), the internal arm portion 61C of the nesting portion 61 is positioned in corresponding alignment with the signal contact arm portion 22 of the receptacle terminal 20, and is formed to have width dimensions that are larger than the external arm portion 61A of the above-mentioned nesting portion 61 as well as the signal contact arm portion 22 of the receptacle terminal 20. As seen in FIG. 5 (A), the internal arm portion 61C has its major surface proximate to the recessed mating portion 56 exposed on the inner surface of the lateral wall 54, and this exposed major surface is formed as a corresponding signal contact portion that contacts the signal contact protrusion 22A of the receptacle terminal 20 under a contact pressure when the connectors are in a mated state.

As seen in FIGS. 3 (A) and (B), the connecting portion 62 is formed to have the same width dimensions as the external arm portion 61A of the nesting portion 61. Said connecting portion 62 extends directly from the upper end of the internal arm portion 61C outwardly in the connector width direction along the bottom face of the bottom wall 51, protrudes out of the housing 50 (see FIG. 1 and FIGS. 6 (A) and (B)), and is solder-connectable to the corresponding signal circuitry on the circuit board. In addition, it is not essential for the width dimensions of the connecting portion 62 to be the same as the width dimensions of the external arm portion 61A of the nesting portion 61, and different width dimensions can be used.

In this embodiment, the external arm portions 61A of the plug terminals 60 are formed to have smaller width dimensions than the internal arm portions 61C. Therefore, the spacing between the external arm portions 61A of mutually adjacent plug terminals 60 is larger than the spacing between the internal arm portions 61C. In this manner, forming large gaps between the internal arm portions 61C makes it possible to minimize electrical signal interference between the plug terminals 60.

In addition, in this embodiment, in the connector width direction, proximate to the signal contact arm portions 22 of the receptacle terminals 20, said signal contact arm portions 22 are formed to have width dimensions that are smaller than the internal arm portions 61C of the plug terminals 60, and, proximate to the internal arm portions 23A of the receptacle terminals 20, the external arm portions 61A of the plug terminals 60 are formed to have width dimensions that are smaller than the above-mentioned internal arm portions 23A. This means that even if, as previously discussed, wide spacing is ensured between the receptacle terminals 20 and between the plug terminals 60 in order to minimize electrical signal interference between adjacent terminals, the width dimensions of the terminals 20, 60 of the two connectors 1, 2 can be kept within the range of the width dimensions of the plug terminals 60 on the signal contact arm portions 22 side, and within the range of the width dimensions of the receptacle terminals 20 on the internal arm portions 23A side. Therefore, even if the terminals 20, 60 are arranged in a tightly spaced relationship, the spacing between the signal contact arm portions 22 of the receptacle terminals 20 and the spacing between the external arm portions 61A of the plug terminals 60 can be respectively increased. In other words, there is no need to increase the array spacing of the terminals 20, 60 as a whole in order to minimize electrical signal interference, and an increase in the size of the two connectors 1, 2 in the above-mentioned array direction can be avoided.

As seen in FIG. 2 and FIG. 4 (A), one plug lock fitting 70 is provided at each end portion of the housing 10 in the above-mentioned array direction to match the receptacle lock fittings 30 of the receptacle connector 1. In addition to the locking feature that enables locking with the receptacle lock fittings 30, said plug lock fittings 70 also possess power supply terminal functionality for contacting and providing electrical communication with the power supply contact arm portions 43 of said receptacle lock fittings 30. However, it is not essential for the plug lock fittings 70 to be provided with power supply terminal functionality.

The plug lock fittings 70 are made by bending sheet metal members in the sheet thickness direction and, as shown in FIG. 1 and FIG. 2, have external plate portions 71, which extend along the external surface of the lateral walls 54 of the housing 50, transitional portions 72, which extend inwardly in the connector width direction from the lower ends of said external plate portions 71, internal plate portions 73, which extend upwardly via said transitional portions 72 along the inner surface of the lateral walls 54, lateral securing portions 74, which extend outwardly in the connector width direction from the upper ends of said internal plate portions 73, coupling portions 75, which extend in the connector width direction and couple the two internal plate portions 73, end retained portions 76, which extend inwardly in the array direction from the lower edge of the coupling portions 75, and end securing portions 77, which extend outwardly in the array direction from the upper edge of coupling portions 75.

As seen in FIG. 1, the external plate portions 71 have their major surfaces exposed on the external surfaces of the lateral walls 54 of the housing 50 and, on the exposed major surfaces, there are formed lockable portions 71A, which have a stepped shape formed therein by sinking into the top portion of said major surfaces and which extend in the width direction (above-mentioned array direction) of said external plate portions 71. Said lockable portions 71A are formed at the same height level (vertical placement) as the lockable portions 61A-1 of the external arm portions 61A of the plug terminals 60. Said lockable portions 71A are adapted to lock with the lock portions 35A of the receptacle lock fittings 30 when the connector is mated with the receptacle connector 1 in the direction of connector extraction.

The transitional portions 72 extend in the connector width direction along the lower surface (upper surface in FIG. 5 (A)) of the lateral walls 54 of the housing 50, with the lower surface (upper surface in FIG. 5 (A)) of said transitional portions 72 being exposed on the lateral walls 54 (see FIG. 5 (A)). The major surfaces of the internal plate portions 73 are exposed on the inner surfaces of the lateral walls 54. In this embodiment, of the two internal plate portions 73 provided in the plug lock fittings 70, the internal plate portion 73 located corresponding to the power supply contact arm portion 43 of the receptacle lock fittings 30 is formed as the corresponding power supply contact portion contacting said power supply contact arm portion 43 under a contact pressure.

The lateral securing portions 74 which, as seen in FIG. 2, extend outwardly in the connector width direction from the upper ends (lower ends in FIG. 5 (A)-(C)) of the internal plate portions 73 and, as seen in FIG. 1, protrude out of the housing 50, are solder-connectable to the corresponding circuitry of the circuit board. In addition, as seen in FIG. 2, said lateral securing portions 74 extend to reach more external locations in the above-mentioned array direction than the internal plate portions 73, which ensures a considerable increase in the mounting surface area that is solder-connectable to the above-mentioned corresponding circuitry.

As seen in FIG. 2, the coupling portions 75 have coupling base portions 75A, which have major surfaces perpendicular to the above-mentioned array direction and extend in the connector width direction, and coupling end portions 75B, which are bent at both ends of said coupling base portions 75A and extend inwardly in the above-mentioned array direction. Said coupling portions 75 are retained in place on the end walls 55 and, as seen in FIG. 1, their major surfaces in the central area in the connector width direction are exposed on the external surfaces of the end walls 55.

The end retained portions 76 are retained in place on the end walls 55 and, as seen in FIG. 5 (A), have their major surfaces exposed on the upper surface (lower surface in FIG. 1) of the end walls 55. As seen in FIG. 1, the end securing portions 77 protrude in the above-mentioned array direction from the bottom wall 51 of the housing 50 and are secured by solder-connecting their upper surfaces (lower surfaces in FIG. 5 (A)) to the corresponding portions of the circuit board.

[Connector Mating Operation]

Figure 6:
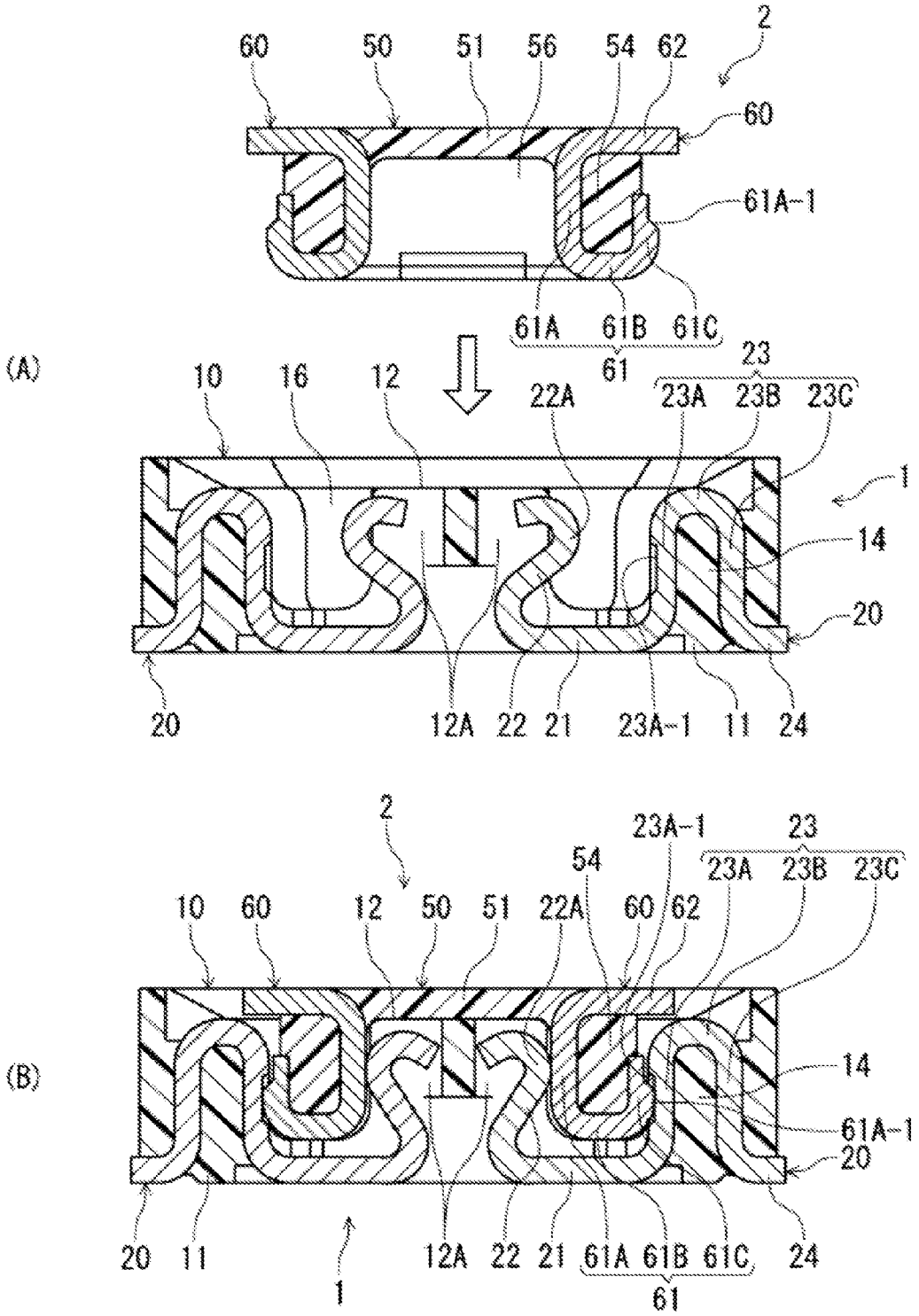
FIG. 6 A cross-sectional view taken in a plane perpendicular to the array direction at the location of the terminals of the plug connector and receptacle connector of FIG. 1 in the above-mentioned array direction, wherein (A) illustrates a state prior to connector mating and (B) illustrates a state after connector mating.

Next, the operation of mating of the connectors 1, 2 will the described with reference to FIG. 1, FIG. 6, and FIG. 7. FIG. 6 and FIG. 7 are, respectively, cross-sectional views of the locations of the terminals 20, 60 and lock fittings 30, 70 of the receptacle connector 1 and plug connector 2 of FIG. 1 in the array direction, taken in a plane perpendicular to the above-mentioned array direction, wherein (A) illustrates a state prior to connector mating, and (B) illustrates a state after connector mating.

First, the receptacle connector 1 is mounted on the circuit board by respectively solder-connecting the connecting portions 24 of the receptacle terminals 20 of the receptacle connector 1 and the lateral securing portions 38 of the receptacle lock fittings 30 to the corresponding circuitry of the circuit board while at the same time solder-connecting the end securing portions 41 of the receptacle lock fittings 30 to the corresponding portions of the circuit board. In addition, the plug connector 2 is mounted on the other circuit board by respectively solder-connecting the connecting portions 62 of the plug terminals 60 of the plug connector 2 and the lateral securing portions 74 of the plug lock fittings 70 to the corresponding circuitry of the above-mentioned other circuit board while at the same time solder-connecting the end securing portions 77 of the plug lock fittings 70 to the above-mentioned corresponding portions of the other circuit board.

Next, as seen in FIGS. 1, 6 (A), and 7 (A), the receptacle connector 1 is brought into an orientation in which the recessed mating portion 16 is upwardly open while at the same time bringing the plug connector 2 into an orientation in which the recessed mating portion 56 is downwardly open and placing it above said receptacle connector 1. Subsequently, as shown by arrows in FIGS. 1, 6 (A), and 7 (A), the plug connector 2 is moved downwardly and the mating portion of said plug connector 2 is nested inside the recessed mating portion 16 of the receptacle connector 1.

As a result, the nesting portions 61 of the plug terminals 60 of the plug connector 2 are inserted into the inside of the receiving portions of the receptacle terminals 20 of the receptacle connector 1, in other words, between the lock portions 23A-1 and the signal contact protrusions 22A by pushing and expanding the gaps. Subsequently, the signal contact arm portions 22 undergo elastic displacement inwardly in the connector width direction. Furthermore, when the insertion of the nesting portions 61 takes place and the connectors are in a mated state, as seen in FIG. 6 (B), the signal contact protrusions 22A are brought into contact with the internal arm portions 61C (corresponding signal contact portions) of the nesting portions 61 under a contact pressure and, at the same time, the lockable portions 61A-1 of the external arm portions 61A of the nesting portions 61 are inserted into the lock portions 23A-1 and are positioned engageably with the upper edges of said lock portions 23A-1 in the direction of connector extraction. As a result, the terminals 20, 60 of the connectors 1, 2 are locked to each other while being in electrical communication.

Figure 7:
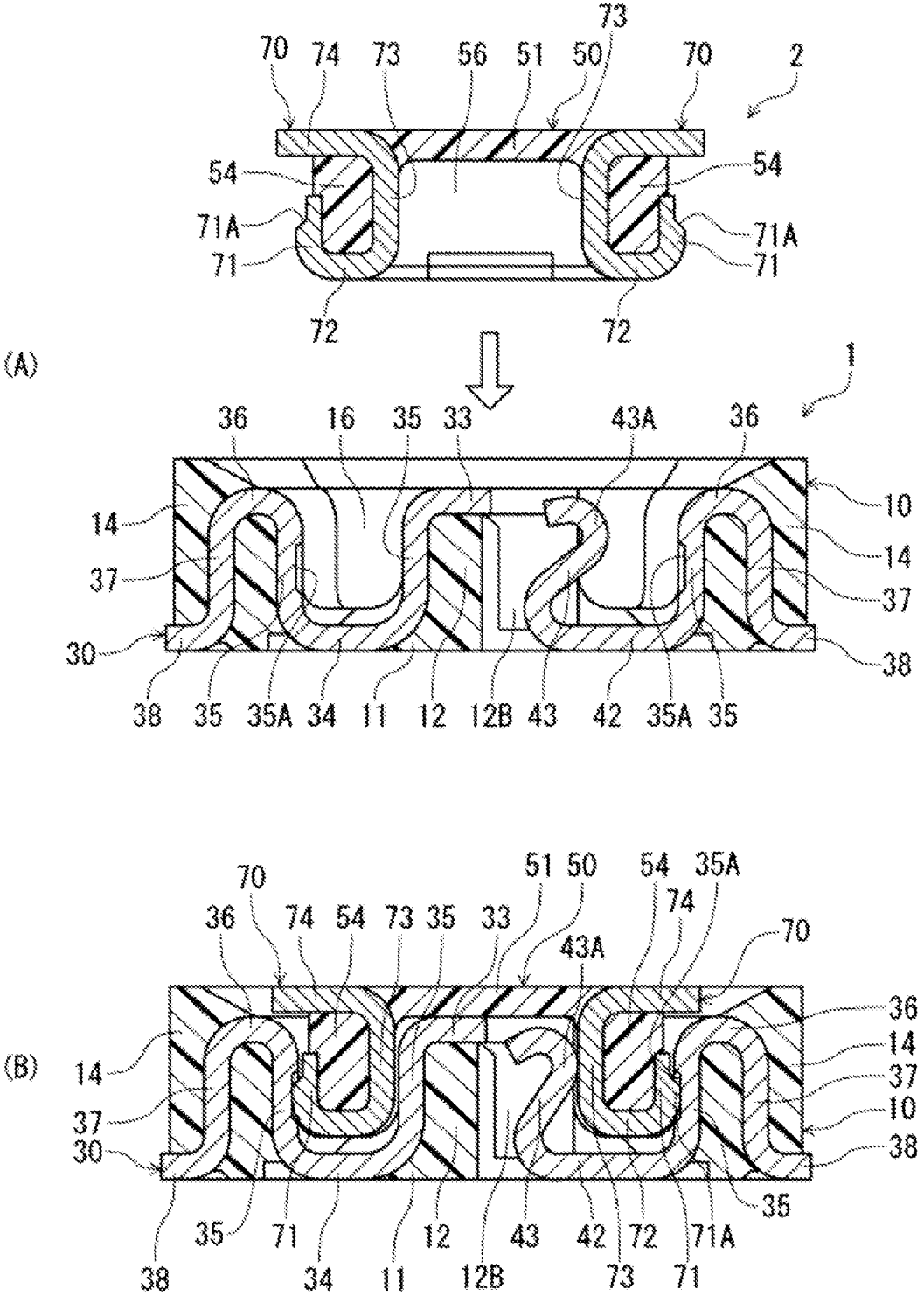
FIG. 7 A cross-sectional view taken in a plane perpendicular to the array direction at the location of the lock fittings of the plug connector and receptacle connector of FIG. 1 in the above-mentioned array direction, wherein (A) illustrates a state prior to connector mating and (B) illustrates a state after connector mating.

In addition, as seen in FIG. 7 (B), under a contact pressure, the power supply contact protrusions 43A are brought into contact with the internal plate portions 73 (corresponding power supply contact portions) of the plug lock fittings 70 located corresponding to said power supply contact arm portions 43. In addition, as seen in FIG. 7 (B), when the connectors are in a mated state, the lockable portions 71A of the plug lock fittings 70 are inserted into the lock portions 35A of the receptacle lock fittings 30 and are positioned engageably with the upper edges of said lock portions 35A in the direction of connector extraction. As a result, the lock fittings 30, 70 are locked to each other while being in electrical communication. This completes the operation of mating of the connectors 1 and 2.

Second Embodiment

Figure 8:
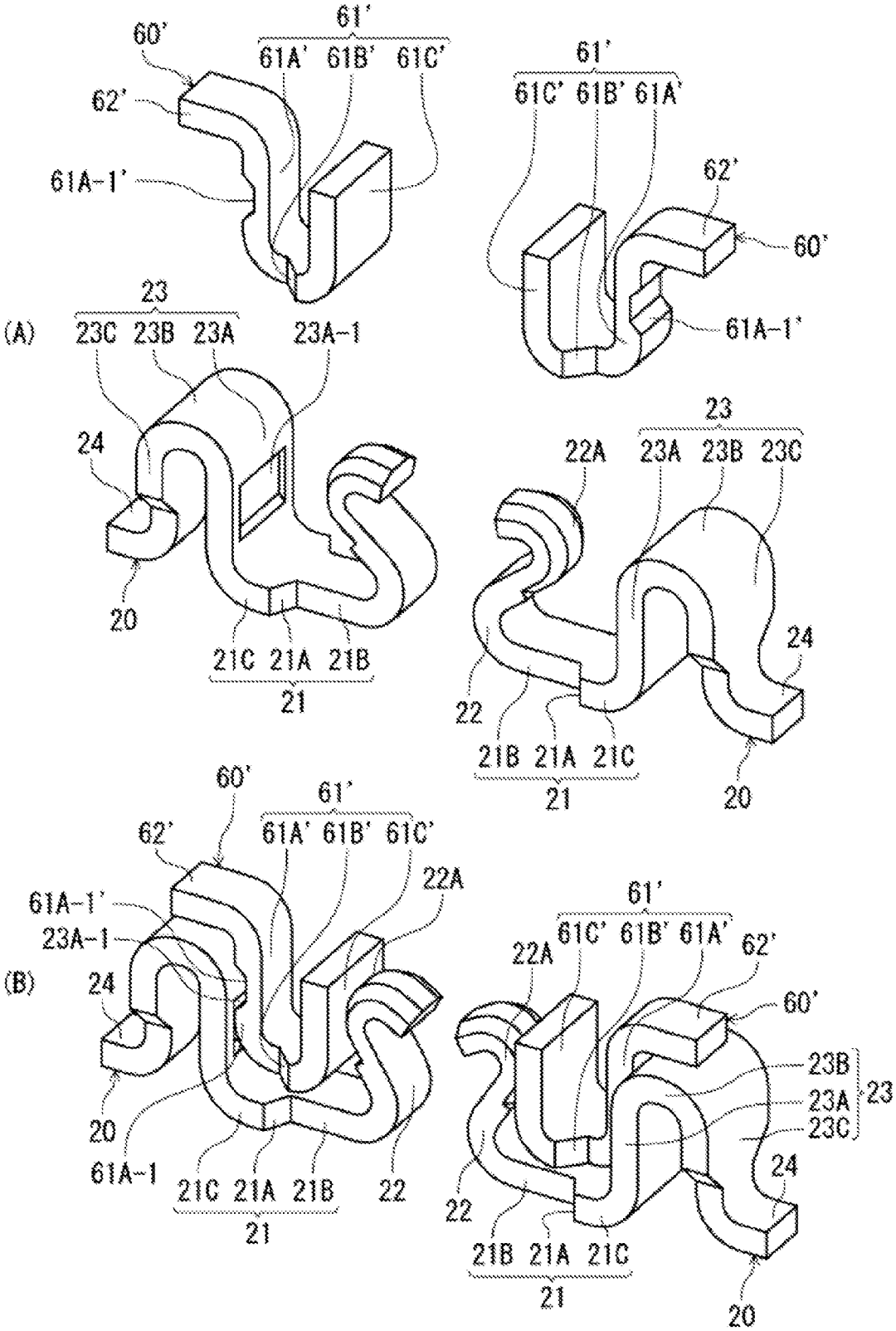
FIG. 8 An oblique view illustrating receptacle terminals and plug terminals according to a second embodiment, wherein (A) illustrates a state prior to connector mating and (B) illustrates a state after connector mating.

The shape of the terminals of the connectors in the present invention is not limited to the shape illustrated in the first embodiment and various modifications are possible. FIGS. 8 (A) and (B) is an oblique view illustrating the receptacle terminals 20 and plug terminals 60 according to the second embodiment, wherein (A) illustrates a state prior to connector mating, and (B) illustrates a state after connector mating. In FIGS. 8 (A) and (B), the plug terminals are indicated by assigning numerals with an added prime sign (') to the sections that correspond to the various portions of the plug terminals 60 of the first embodiment. As seen in FIGS. 8 (A) and (B), in this embodiment, the connecting portion 62' of the plug terminal 60' extends outwardly in the connector width direction from the upper end of the external arm portion 61A' of the nesting portion 61', and this is the point of difference in comparison with the first embodiment, in which the connecting portion 62 of the plug terminal 60 extends from the internal arm portion 61C of the nesting portion 61. It should be noted that the configuration of the receptacle terminals 30 of the present embodiment is absolutely identical to that of the receptacle terminals 30 of the first embodiment.

Although in the first and second embodiment the receptacle connector and plug connector had their terminals retained in place by unitary co-molding with the housing, alternatively, the terminals can be retained in place by, for example, providing retaining groove portions in the housing and press-fitting said terminals into said retaining groove portions.

DESCRIPTION OF REFERENCE NUMERALS

1 Receptacle connector (first connector)
2 Plug connector (second connector)
10 Housing
20 Receptacle terminal (first connector terminal)
22 Signal contact arm portion (elastic arm portion)
23A Internal arm portion (securing arm portion)
23A-1 Lock portion
50 Housing
60, 60' Plug terminals
61, 61' Nesting portions
61A, 61A' External arm portions (sections that correspond to securing arm portions)
61A-1, 61A-1' Lockable portions
61C, 61C' Internal arm portions (sections that correspond to elastic arm portions)

The invention claimed is:

1. An electrical connector assembly in which a first electrical connector disposed on a circuit board is mutually mated with a second electrical connector disposed on another circuit board, the direction of mating being diametrically opposite to the circuit boards, such that, the electrical connector assembly comprising:

the two electrical connectors each having a plurality of terminals fabricated by bending metal strip-shaped pieces in a sheet thickness direction and housings that retain the plurality of terminals in an array form, such that the array direction is parallel to the surface of the circuit boards;

the terminals of the first electrical connector having U-shaped receiving portions that have elastic arm portions elastically displaceable in the sheet thickness direction on one side and securing arm portions secured to the housing on the other side, with the elastic arm portions having contact portions to provide contact with the terminals of the second electrical connector; and the terminals of the second electrical connector have nesting portions nestable into the receiving portions of the terminals of the first electrical connector;

wherein:

in the terminals of the first electrical connector, the elastic arm portions have width dimensions in the array direction smaller than the securing arm portions;

in the terminals of the second electrical connector, the sections that correspond to the securing arm portions have width dimensions smaller than the sections that correspond to the elastic arm portions;

on the elastic arm portions side, the terminals of the first electrical connector have width dimensions smaller than the terminals of the second electrical connector; and on the securing arm portions side, the terminals of the second electrical connector have width dimensions smaller than the terminals of the first electrical connector.

2. The electrical connector assembly according to claim 1, wherein the terminals of the first electrical connector have lock portions in the securing arm portions, and the terminals of the second electrical connector have lockable portions, engageable with the lock portions, in the sections that correspond to the securing arm portions.

3. The electrical connector assembly according to claim 2, wherein the lock portions of the terminals of the first electrical connector are recessed portions that are sunk into major surfaces of the securing arm portions, and the lockable portions of the terminals of the second electrical connector are stepped portions or protrusions that can be inserted into the lock portions on the major surfaces of the sections that correspond to the securing arm portions.

4. An electrical connector assembly, wherein width dimensions of terminals of a first electrical connector are decreased from securing arm portions toward elastic arm portions, and width dimensions of terminals of a second electrical connector are decreased from sections that correspond to the elastic arm portions toward the sections that correspond to the securing arm portions.

5. The electrical connector assembly according to claim 4, wherein the terminals of the first electrical connector have lock portions in the securing arm portions, and the terminals of the second electrical connector have lockable portions, engageable with the lock portions, in the sections that correspond to the securing arm portions.

6. The electrical connector assembly according to claim 5, wherein the lock portions of the terminals of the first electrical connector are recessed portions formed sunk into major surfaces of the securing arm portions, and the lockable portions of the terminals of the second electrical connector are stepped portions or protrusions that can be inserted into the lock portions on the major surfaces of the sections that correspond to the securing arm portions.

* * * * *